US009096340B1

(12) United States Patent
Berg

(10) Patent No.: US 9,096,340 B1
(45) Date of Patent: Aug. 4, 2015

(54) BOX DESIGN WITH CORNER STACK TABS

(71) Applicant: Boise Packaging & Newsprint, L.L.C., Boise, ID (US)

(72) Inventor: Warren Berg, Walla Walla, WA (US)

(73) Assignee: Boise Packaging & Newsprint, L.L.C., Boise, ID (US)

( * ) Notice: Subject to any disclaimer, the term of this patent is extended or adjusted under 35 U.S.C. 154(b) by 0 days.

(21) Appl. No.: 14/271,250

(22) Filed: May 6, 2014

Related U.S. Application Data

(60) Provisional application No. 61/860,031, filed on Jul. 30, 2013.

(51) Int. Cl.

| | |
|---|---|
| ***B65D 21/032*** | (2006.01) |
| ***B65D 5/32*** | (2006.01) |
| ***B65D 5/00*** | (2006.01) |

(52) U.S. Cl.
CPC ..... *B65D 5/001* (2013.01); *B65D 5/002* (2013.01); *B65D 5/323* (2013.01)

(58) Field of Classification Search
CPC ..... B65D 5/002; B65D 5/0025; B65D 5/003; B65D 5/0035; B65D 5/0045; B65D 5/0055; B65D 5/006
USPC ..... 229/915, 918, 919
See application file for complete search history.

(56) References Cited

U.S. PATENT DOCUMENTS

| | | | | |
|---|---|---|---|---|
| 4,053,098 | A | 10/1977 | Baptist | |
| 4,151,948 | A | 5/1979 | de la Fuente, Jr. | |
| 5,549,242 | A * | 8/1996 | Gimeno | 229/918 |
| 5,735,405 | A * | 4/1998 | Vila | 206/511 |
| 5,860,590 | A | 1/1999 | Blomfield et al. | |
| 6,186,393 | B1 * | 2/2001 | Tsamourgelis | 229/122.26 |
| 6,270,009 | B1 | 8/2001 | Heeren | |
| 6,712,214 | B1 * | 3/2004 | Wintermute et al. | 206/509 |
| 6,938,820 | B2 | 9/2005 | Noone et al. | |
| 7,246,737 | B2 * | 7/2007 | Teixidor Casanovas | 229/918 |
| 7,669,754 | B2 * | 3/2010 | Teixidor Casanovas et al. | 229/918 |
| 8,640,871 | B2 | 2/2014 | Moss | |

FOREIGN PATENT DOCUMENTS

| | | | |
|---|---|---|---|
| EP | 485032 A1 * | 5/1992 | B65D 5/0045 |
| FR | 2618412 | 1/1989 | |
| GB | 2232403 | 12/1990 | |
| WO | WO2005/037662 | 4/2005 | |

* cited by examiner

*Primary Examiner* — Gary Elkins
(74) *Attorney, Agent, or Firm* — Klarquist Sparkman, LLP

(57) ABSTRACT

The present disclosure relates to improved box designs and methods of making stackable boxes having improved designs. Some embodiments include boxes having corner stack tabs that are bent along an axis extending from the top to the bottom of a box. Some embodiments include boxes having corner stack tabs of tapered or generally trapezoidal shape. Some embodiments include a box having a notch in its bottom end portion for receiving a stack tab of another box. Some embodiments include boxes formed from three separate sheets of cardboard.

16 Claims, 9 Drawing Sheets

<==CORR==>

BOX DESIGN WITH CORNER STACK TABS

CROSS REFERENCE TO RELATED APPLICATION

This application claims the benefit of U.S. Provisional Patent Application No. 61/860,031, filed Jul. 30, 2013, which is hereby incorporated herein by reference in its entirety.

FIELD

The present application is directed to the field of box designs, and in particular, to improved designs of stackable boxes and methods of assembling boxes having such improved designs.

BACKGROUND

Various box designs are known in the art. Some boxes are assembled from a single sheet of paperboard (e.g., cardboard) material. For example, a box design can be cut into a single sheet of cardboard, and a cardboard box can be assembled by folding the cardboard along fold lines to form a completed box. Other boxes are assembled from more than one sheet of cardboard material. For example, a design can be cut into each of several sheets of cardboard material, and a cardboard box can be assembled by folding the cardboard sheets along fold lines and then adhering the sheets of cardboard material to one another to form a completed box. Some boxes are designed to be stackable, for example, so that a first box of a particular design can be stacked on top of a second box of the same design. Improvements in the design and manufacture of boxes, including stackable boxes, can improve the ease and efficiency of storage, transportation, and display of goods in various settings, and are thus always desirable.

SUMMARY

In some embodiments, a box comprises a top end portion and a bottom end portion, the top end portion including at least one stack tab having a tapered shape as it extends away from the top end portion of the box, the stack tab bent to form an angle of 135 degrees about an axis extending from the top end portion to the bottom end portion, and the bottom end portion including at least one notch. In some embodiments, such a box is a first box situated on top of a second box, the second box comprising a top end portion and a bottom end portion, the top end portion of the second box including at least one stack tab, the stack tab of the second box having a tapered shape as it extends away from the top end portion of the second box, the stack tab of the second box bent to form an angle of 135 degrees about an axis extending from the top end portion of the second box to the bottom end portion of the second box, the stack tab of the second box situated within the notch of the first box, and the bottom end portion of the second box including at least one notch configured to receive a stack tab of a third box.

In some embodiments, the stack tab comprises a single layer of cardboard material. In some embodiments, the box is comprised of three separate sheets of cardboard material. In some embodiments, the stack tab has a shape comprising a trapezoid. In some embodiments, the stack tab has a shape comprising a trapezoid with rounded corners. In some embodiments, the stack tab has a shape comprising a base portion and a top portion, the top portion being smaller in cross-section than the base portion. In some embodiments, the stack tab has a shape comprising a portion of a circle.

In some embodiments, a box comprises a first box portion having a first side portion, a bottom portion, and a second side portion, wherein a first fold line separates the first side portion from the bottom portion and a second fold line separates the bottom portion from the second side portion, and a second box portion having an angle portion, an end portion, a stack tab, and a notch, wherein a third fold line separates the angle portion from the end portion, wherein the stack tab extends outwardly from the angle portion and the end portion, straddling the third fold line, and wherein the notch extends inwardly into the angle portion and the end portion, straddling the third fold line, wherein the second box portion folded at the third fold line such that an angle between the angle portion and the end portion is 135 degrees, and the stack tab has a tapered shape as it extends outwardly from the angle portion and the end portion.

In some embodiments, such a box is a top box situated on top of a bottom box, the bottom box comprising a first box portion having a first side portion, a bottom portion, and a second side portion, wherein a first fold line separates the first side portion of the bottom box from the bottom portion of the bottom box and a second fold line separates the bottom portion of the bottom box from the second side portion of the bottom box, and a second box portion having an angle portion, an end portion, a stack tab, and a notch, wherein a third fold line separates the angle portion of the bottom box from the end portion of the bottom box, wherein the stack tab of the bottom box extends outwardly from the angle portion of the bottom box and the end portion of the bottom box, straddling the third fold line of the bottom box, and wherein the notch of the bottom box extends inwardly into the angle portion of the bottom box and the end portion of the bottom box, straddling the third fold line of the bottom box, the second box portion of the bottom box folded at the third fold line of the bottom box such that an angle between the angle portion of the bottom box and the end portion of the bottom box is 135 degrees, and the stack tab of the bottom box is situated within the notch of the top box.

In some embodiments, the first box portion and the second box portion each comprise a separate respective sheet of cardboard material. In some embodiments, the stack tab comprises a single layer of cardboard material. In some embodiments, the box comprises three separate sheets of cardboard material. In some embodiments, the stack tab has a shape comprising a trapezoid.

In some embodiments, a method of assembling a box comprises cutting a first sheet of cardboard material so the first sheet of cardboard material comprises a first side portion, a bottom portion, and a second side portion, cutting a second sheet of cardboard material so the second sheet of cardboard material comprises an angle portion, an end portion, a stack tab, and a notch, folding the first sheet of cardboard material along a first fold line defining a boundary between the first side portion and the bottom portion and along a second fold line defining a boundary between the bottom portion and the second side portion, folding the second sheet of cardboard material along a third fold line defining a boundary between the angle portion and the end portion, wherein the stack tab and the notch both straddle the third fold line, and coupling the first sheet of cardboard material to the second sheet of cardboard material so that the bottom portion forms a bottom of the box and so that the first side portion, second side portion, and end portion form walls of the box.

In some such methods, cutting the second sheet of cardboard material comprises cutting the second sheet of cardboard material such that the second sheet of cardboard material further comprises a side attachment portion, the method further comprising folding the second sheet of cardboard material along a fourth fold line defining a boundary between the angle portion and the side attachment portion, and coupling the first sheet of cardboard material to the second sheet of cardboard material comprises gluing the side attachment portion of the second sheet of cardboard material to the first side portion of the first sheet of cardboard material.

In some embodiments, folding the second sheet of cardboard material comprises folding the second sheet of cardboard material so that an angle between the angle portion and the end portion is 135 degrees. In some embodiments, cutting the second sheet of cardboard material comprises cutting the second sheet of cardboard material so that the stack tab has a tapered shape as it extends outwardly from the angle portion and the end portion.

The foregoing and other objects, features, and advantages of the invention will become more apparent from the following detailed description, which proceeds with reference to the accompanying figures.

DETAILED DESCRIPTION

The explanations of terms and abbreviations herein are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following detailed description and the claims.

Unless otherwise indicated, all numbers expressing dimensions, angles, percentages, and so forth, as used in the specification or claims are to be understood as being modified by the term "about." Unless otherwise indicated, non-numerical properties as used in the specification or claims are to be understood as being modified by the term "substantially," meaning to a great extent or degree. Accordingly, unless otherwise indicated, implicitly or explicitly, the numerical parameters and/or non-numerical properties set forth are approximations that may depend on the desired properties sought, limits of detection under standard test conditions/methods, limitations of the processing method, and/or the nature of the parameter or property. When directly and explicitly distinguishing embodiments from discussed prior art, the embodiment numbers are not approximates unless the word "about" is recited.

Figure 1B:
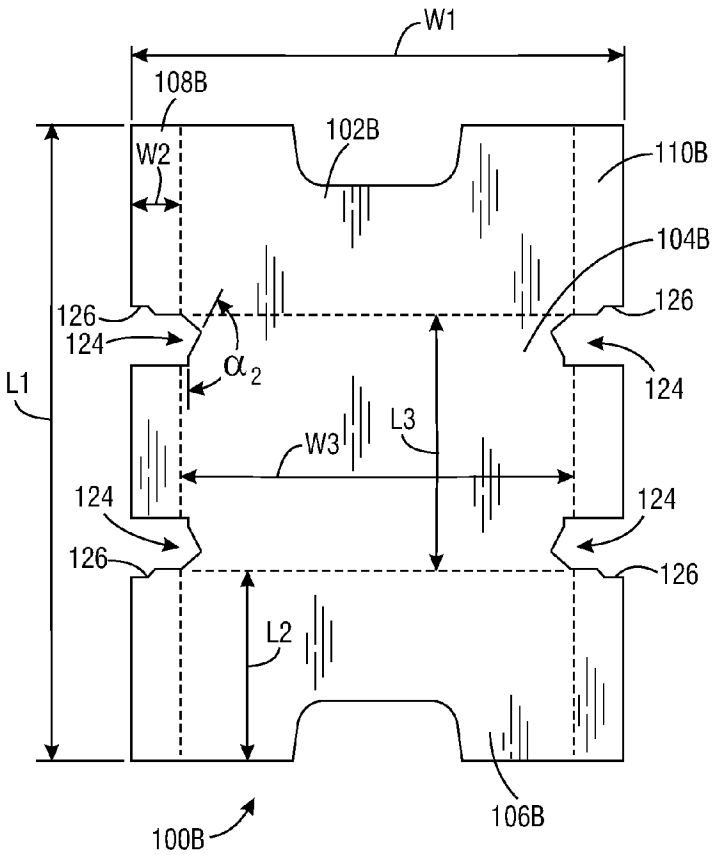
FIG. 1B shows another exemplary first box portion with exemplary dimensions.
Figure 1A:
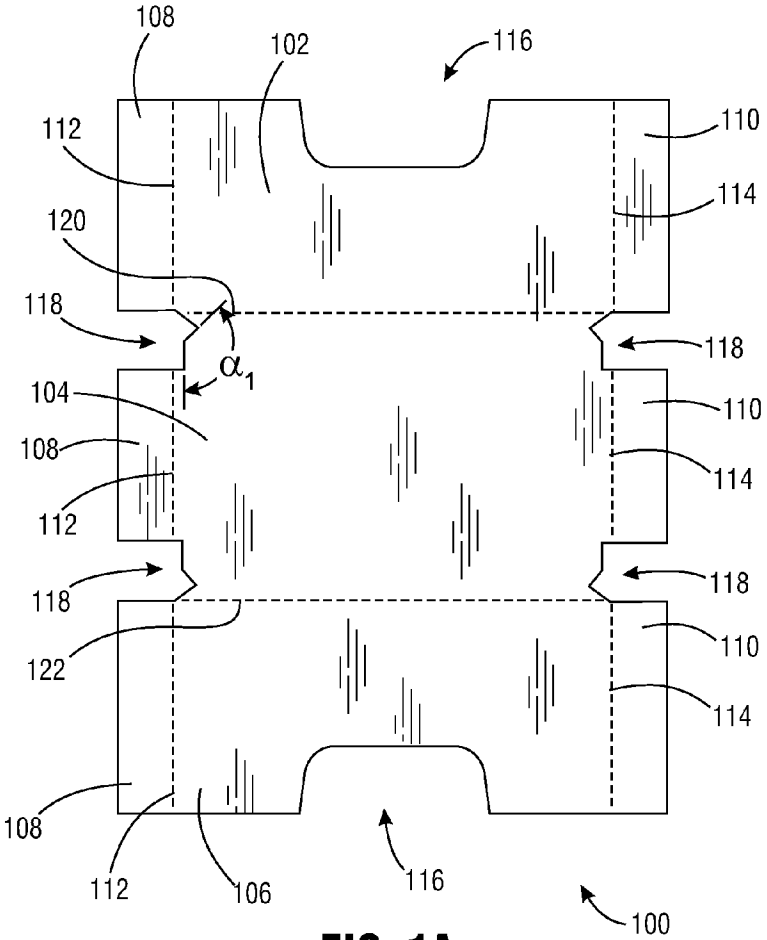
FIG. 1A shows an exemplary first box portion.

FIG. 1A shows an exemplary first box portion 100. As shown, the first box portion 100 can comprise a first side portion 102, a bottom portion 104, and a second side portion 106. Fold line 120 can separate first side portion 102 from bottom portion 104 and fold line 122 can separate bottom portion 104 from second side portion 106. Each of the first side portion 102, bottom portion 104, and second side portion 106 can include a first end tab 108 and a second end tab 110. Fold lines 112 can separate each of the first end tabs 108 from the rest of the first box portion 100, and fold lines 114 can separate each of the second end tabs 110 from the rest of the first box portion 100. The first side portion 102 and the second side portion 106 can each include a cutout area 116.

FIG. 1A shows that the bottom portion 104 can include four stack tab receiving cutouts 118, one in each of the four corners of the bottom portion 104, which can be sized to receive stack tabs of another box, as further explained below. The cutouts 118 can have a generally angled shape, as shown, to accommodate an angled stack tab as described below.

FIG. 1B shows another exemplary first box portion 100B, which can have a structure similar to that of first box portion 100, including a first side portion 102B, a bottom portion 104B, a second side portion 106B, and end tabs 108B and 110B. FIG. 1B shows that the bottom portion 104B can include four stack tab receiving cutouts 124, one in each of the four corners of the bottom portion 104B, which can be sized to receive stack tabs of another box, as further explained below. The cutouts 124 can have a generally angled shape to accommodate an angled stack tab as described below.

The cutouts 118 and the cutouts 124 have similar but not identical shapes. Thus, the cutouts 118 and the cutouts 124 can accommodate stack tabs of slightly different configurations. More specifically, the angle $\alpha 1$ of cutouts 118 is smaller than the angle $\alpha 2$ of cutouts 124. The cutouts 118 can accommodate corner stack tabs bent to form an angle of about $\alpha 1$, and the cutouts 124 can accommodate corner stack tabs bent to form an angle of about $\alpha 2$. In alternative embodiments, the cutouts can have various other suitable configurations. FIG. 1B also shows that the first side portion 102B and second side portion 106B can be provided with indentations 126. In some cases, these indentations 126 can facilitate the insertion of the stack tab of another box into the cutouts 124 (see, e.g., the location of indentations 126 in box 300 shown in FIG. 3). In some cases, these indentations 126 can provide channels through which air can flow (e.g., from the bottom of the box, through the indentation, and out the top of the box, or in the reverse direction) to facilitate aeration of the products carried in the box.

FIG. 1B shows that the first box portion 100B can have an overall length L1, which in some embodiments is 38 4/16", and an overall width W1, which in some embodiments is 29 10/16". The first and second side portions 102B, 106B can each have an overall length L2, which in some embodiments is 11 6/16, and the bottom portion 104B can have an overall length L3 which in some embodiments is 15⁸⁄₁₆". The end tabs 108B, 110B can have a width W2, which in some embodiments is 3". The first side portion 102B, bottom portion 104B, and second side portion 106B, excluding the end tabs 108B, 110B, can each have a width W3, which in some embodiments is 23¹⁰⁄₁₆".

Figure 2A:
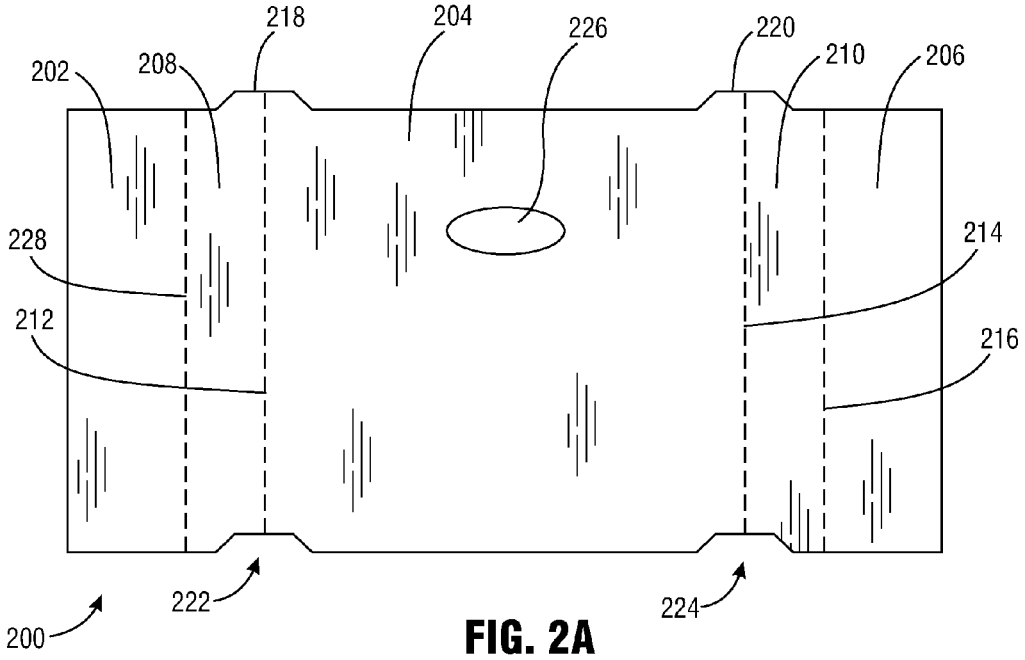
FIG. 2A shows an exemplary second box portion.
Figure 2B:
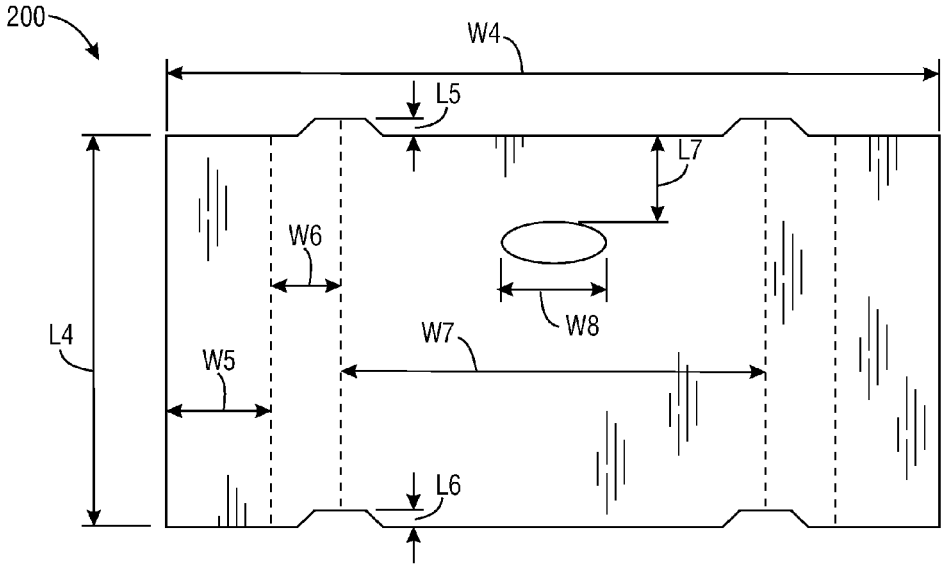
FIG. 2B shows the second box portion of FIG. 2A with exemplary dimensions.

FIGS. 2A-2B show an exemplary second box portion 200. As shown, the second box portion 200 can comprise a first side portion 202, an end portion 204, and a second side portion 206. The second box portion 200 can also include a first intermediate angle portion 208 and a second intermediate angle portion 210. Fold line 228 can separate first side portion 202 from first intermediate angle portion 208, fold line 212 can separate angle portion 208 from end portion 204, fold line 214 can separate end portion 204 from second angle portion 210, and fold line 216 can separate angle portion 210 from second side portion 206.

Second box portion 200 can also include first stack tab 218 and second stack tab 220, as well as first tab receiving receptacle, or notch 222 and second tab receiving notch 224. The tab 218 and notch 222 can straddle the fold line 212 such that when the second box portion is folded along line 212, the tab 218 and the notch 222 are bent into an angled shape. The tab 220 and notch 224 can straddle the fold line 214 such that when the second box portion is folded along line 214, the tab 220 and the notch 224 are bent into an angled shape. The stack tabs 218, 220, can have a generally trapezoidal shape, as shown, or can be formed in various other shapes as desired. In some embodiments, the stack tabs 218, 220 have a wider base portion and a relatively narrower top portion. In some embodiments, the tabs 218, 220 can have a generally tapered shape which tapers from the base portion to the top portion. In alternative embodiments, the tabs can have a generally curved shape, such as a portion of a circle or a semi-circle, a portion of an oval, or a portion of an ellipse. In other embodiments, the tabs can have a generally trapezoidal shape, and can have rounded corners. In cases where the stack tabs 218, 220 have a trapezoidal shape, the angle between the side of the trapezoid and the bottom of the trapezoid can be 45°. In alternative embodiments, this angle can be between 40° and 50°, between 30° and 60°, or between 15° and 75°. These are alternative embodiments which are not necessarily equivalent to one another.

The notches 222, 224 can be sized to receive stack tabs of another box, as further explained below. For example, the notches 222, 224 can have a generally trapezoidal shape, as shown, to accommodate the generally trapezoidal shape of the stack tabs of another box. The disclosed shapes of the stack tabs 218, 220, and corresponding shapes of the notches 222, 224 are important at least because they facilitate the stacking of a plurality of boxes on top of one another. For example, a tab with a wider base portion and a narrower top portion can be more easily inserted into a notch with a wider base portion and narrower top portion. That is, the top portion of the tab is more easily inserted into the wide base portion of the notch, and once such inserted is initiated, a tapered shape can help to facilitate the further insertion of the tab into the notch. This can help make the act of stacking of boxes more efficient. The second box portion 200 can also include an elliptically shaped cutout 226 which can function as a handle for an assembled box.

FIG. 2B shows that the second box portion 200 can have an overall length L4, which in some embodiments is 11⁴⁄₁₆", and an overall width W4, which in some embodiments is 22⁴⁄₁₆". The first side portion 202 and second side portion 206 can each have a width W5, which in some embodiments is 3". The first and second angle portions 208, 210, can have a width W6, which in some embodiments is 2". The end portion 204 can have a width W7, which in some embodiments is 12⁴⁄₁₆". The tabs 218, 220 can have a length L5, which in some embodiments is ⁸⁄₁₆", and the notches 222, 224 can have a length L6, which in some embodiments is ⁸⁄₁₆". The elliptically shaped cutout 226 can have a major axis of width W8, which in some embodiments is 3", and can be offset from the edge of the second box portion 200 by a length L7, which in some embodiments is 2⁸⁄₁₆".

The recited dimensions represent exemplary dimensions suitable in some embodiments. In alternative embodiments, the dimensions of the various components illustrated in FIGS. 1-2 can change based on the product to be carried in the box and other various design requirements. In some embodiments, a box incorporating the features described herein can have an overall length of 41", width of 19¹³⁄₁₆", and depth of 15¹⁴⁄₁₆". In some other embodiments, a box incorporating the features described herein can have an overall length of 8⁷⁄₁₆", width of 7¹³⁄₁₆", and depth of 3¹⁴⁄₁₆".

Figure 3:
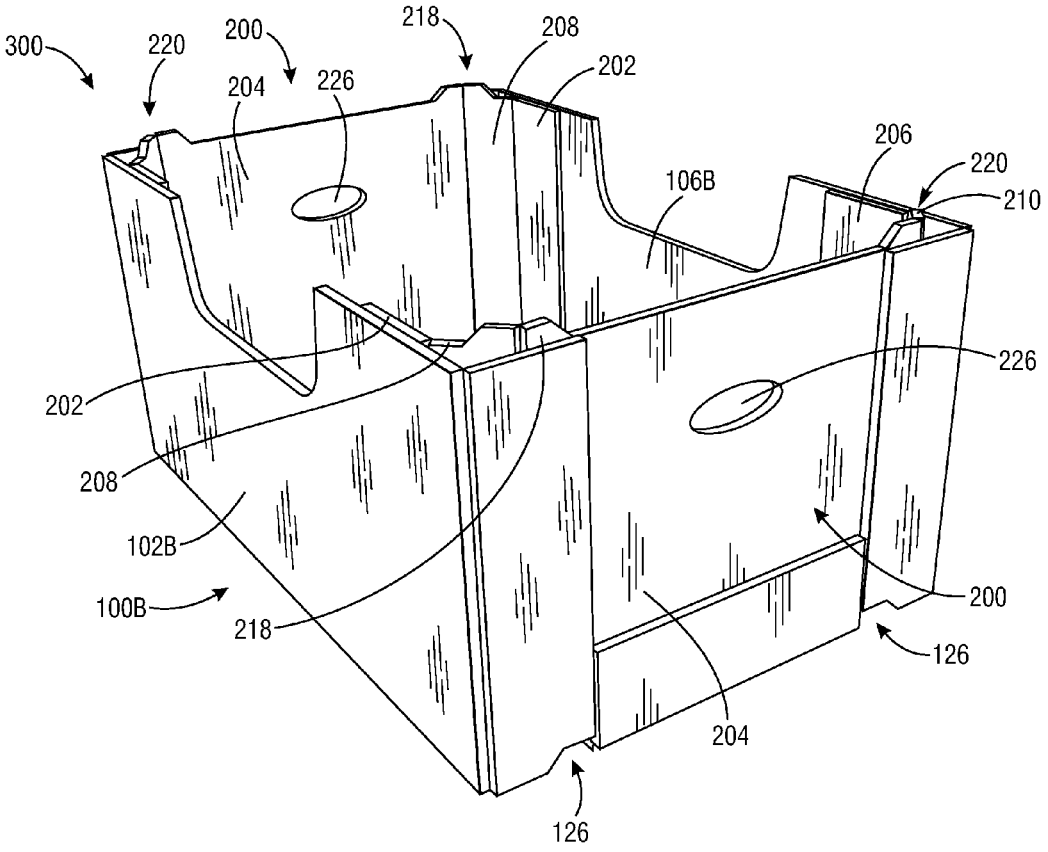
FIG. 3 shows a perspective view of an exemplary box formed from a first box portion and two second box portions.

FIG. 3 shows an exemplary box 300 formed from a first box portion 100B, having been folded along its respective fold lines, and two of the second box portions 200, each having been folded along its respective fold lines. The first box portion 100B and two second box portions 200 can be coupled two one another using any suitable means, with one exemplary means being an adhesive such as glue. As can be seen in FIG. 3, box 300 has a first side portion formed primarily from first side portion 102B, a second side portion formed primarily from second side portion 106B, a first end portion formed primarily from an end portion 204, and a second end portion formed primarily from another end portion 204. Box 300 has two stack tabs 218 and two stack tabs 220, each of which rises above the top of the rest of the box 300, and thus can engage with the cutouts 124 and notches 222, 224 of another box.

FIG. 3 shows that an angle between the angle portions 208, 210, and the respective end portions 204 (i.e., the angle of the fold along fold lines 212, 214, or the angle formed in the stack tabs 218, 220, or the angle to which the stack tabs 218, 220 are bent) can be 135°. This angle can in alternative embodiments be any of various suitable angles, and can vary due to variability inherent in manufacturing processes. In alternative embodiments, this angle can be between 130° and 140°, between 120° and 150°, or between 110° and 160°. In these embodiments, the angle is greater than 90°. Stack tabs having an angle greater than 90° can be particularly advantageous, as the larger angle increases the ease with which a top box can be stacked on top of a bottom box. Angle $\alpha 1$ or angle $\alpha 2$ can be selected to accommodate the angle of the fold along the fold lines 212, 214. A bent or angled stack tab can help make the stack tab stronger in bending (e.g., by increasing the moment of inertia of the stack tab), thus reducing the amount of raw material required to provide a stack tab having a desired strength, or increasing the strength of a stack tab fabricated from a given amount of raw material.

Figure 4:
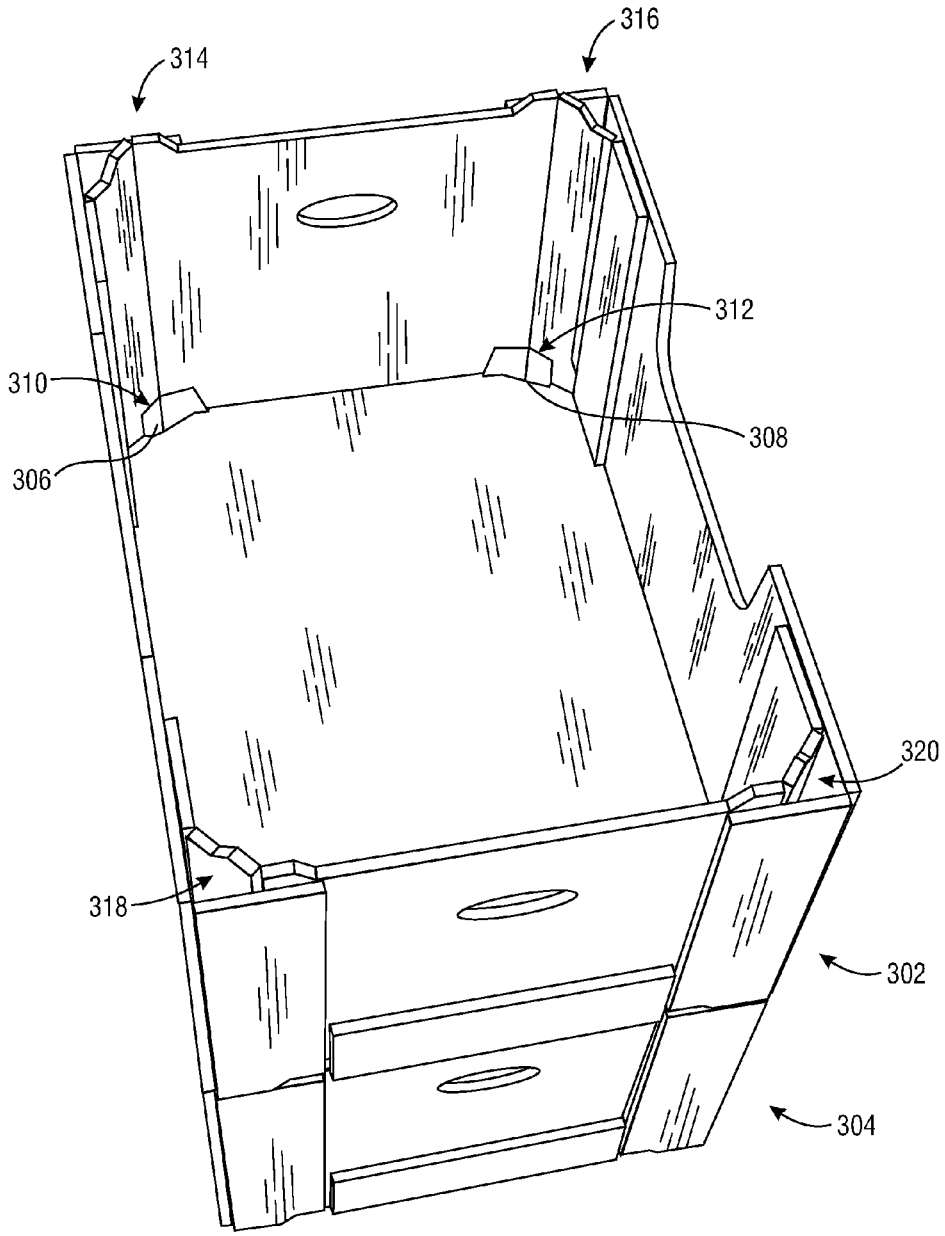
FIG. 4 shows two of the exemplary box of FIG. 3 stacked on top of one another, from a top perspective view.
Figure 5:
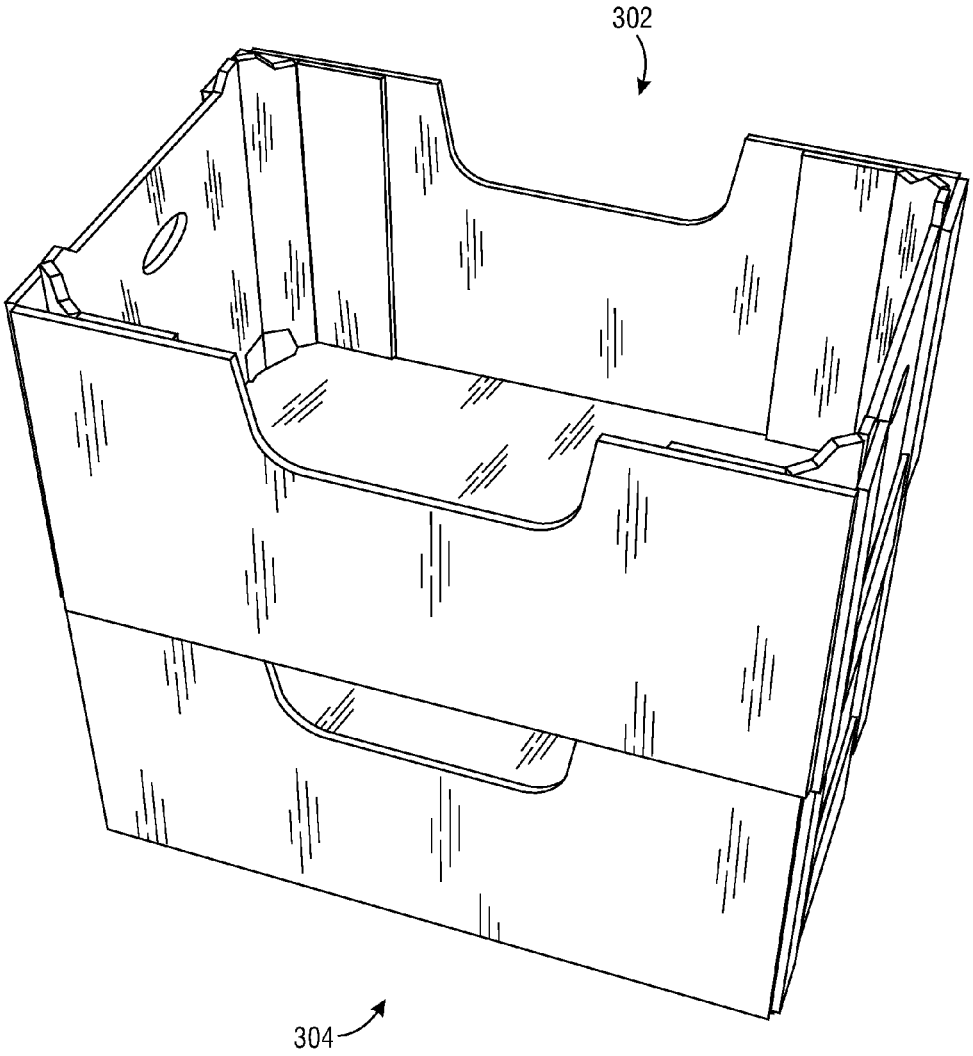
FIG. 5 shows the two stacked boxes of FIG. 4 from another view.
Figure 6:
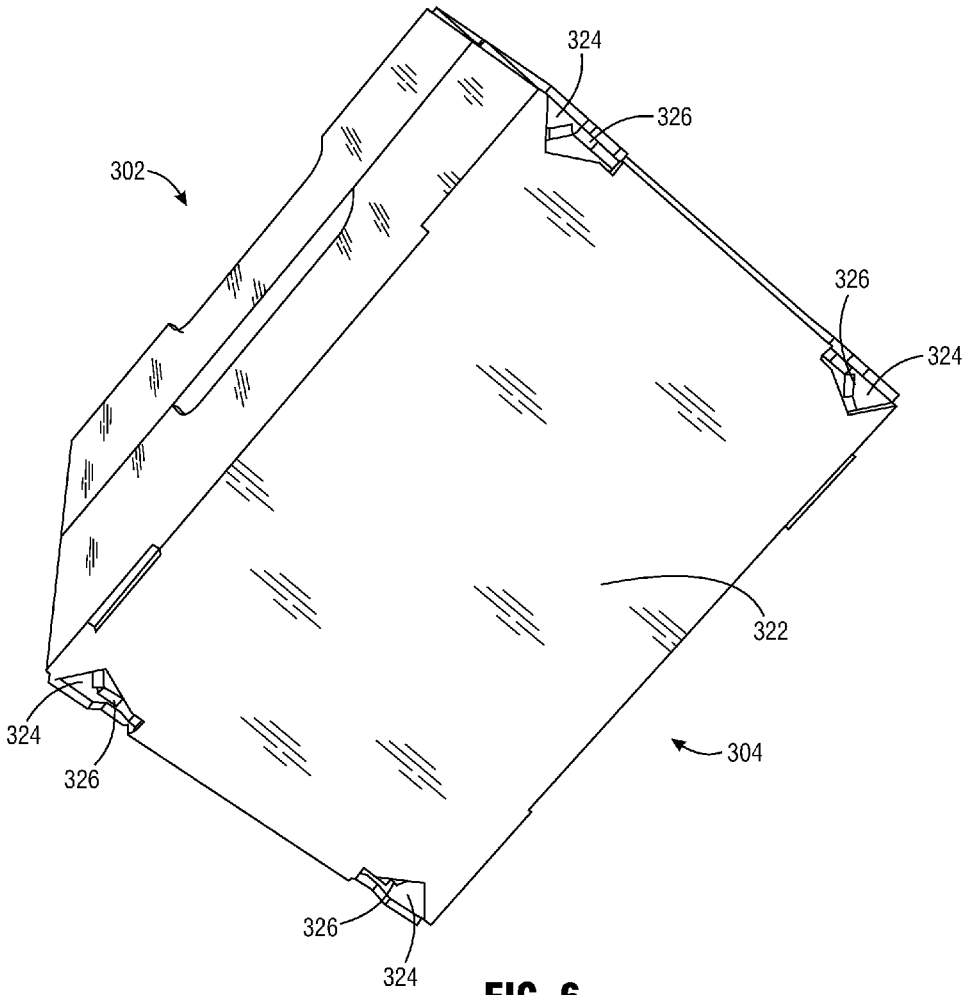
FIG. 6 shows the two stacked boxes of FIG. 4 from another view.
Figure 7:
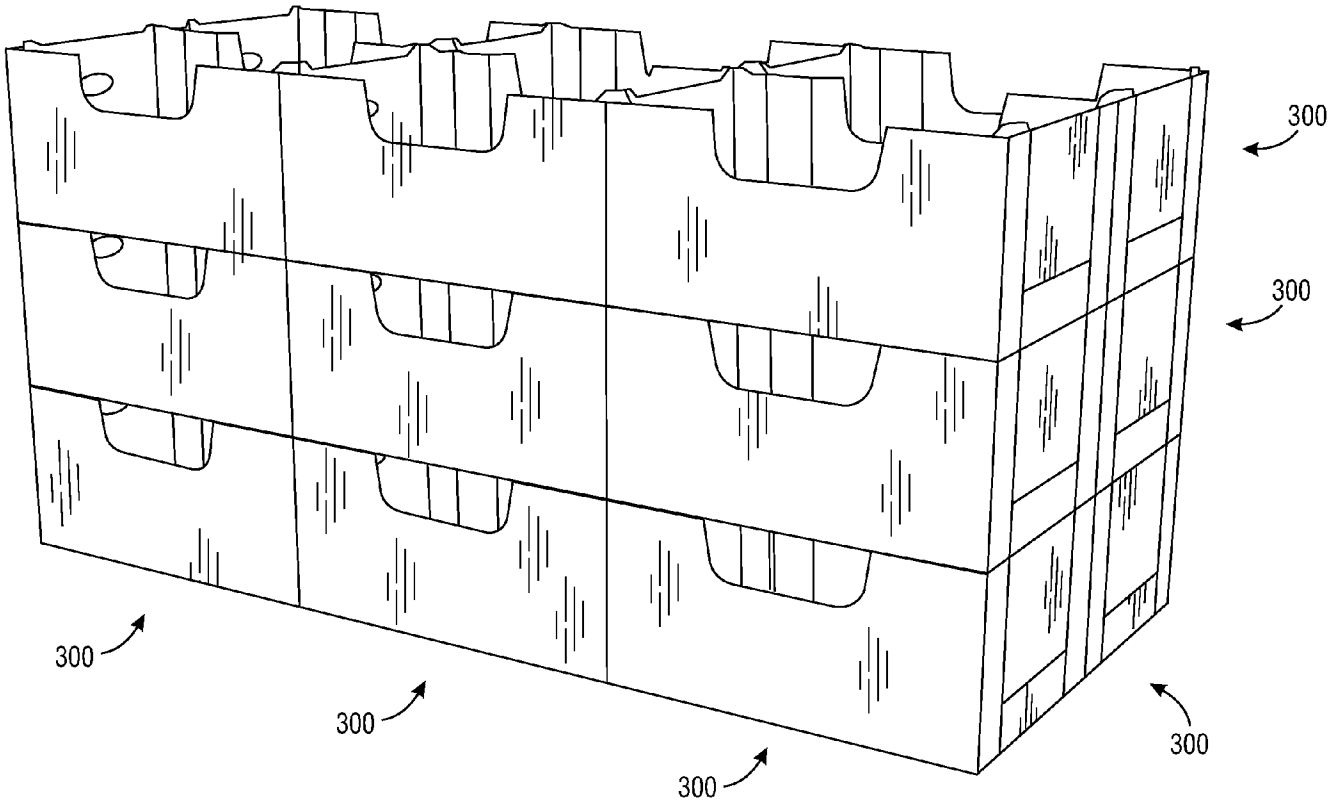
FIG. 7 shows eighteen exemplary boxes, each formed from a first box portion and two second box portions, in an exemplary stacked arrangement.

FIG. 4 shows a top box 302 stacked on top of a bottom box 304. Top box 302 and bottom box 304 can be formed in the manner described above with regard to box 300. As shown, the bottom box 304 has stack tabs 306, 308 that engage with notches 310, 312 formed in the top box 302. Top box 302 also has stack tabs 314, 316, 318, 320 that can engage cutouts and notches in another box (not illustrated) to be situated on top of the top box 302. FIG. 5 shows the boxes 302, 304, from another view. FIG. 6 shows the boxes 302, 304, from another view. As shown in FIG. 6, a bottom portion 322 of box 304 includes cutouts 324 and notches 326, each formed to engage the stack tabs of another box (not illustrated) to be situated below the bottom box 304. FIG. 7 shows eighteen exemplary boxes 300, in an exemplary stacked arrangement.

The box 300 can be assembled from three different sheets of cardboard material. Thus, the box 300 can be referred to as a "bliss box," a term used herein to refer to a box assembled from three different sheets of cardboard material, in contrast to a "tray-style" box, which is a cardboard box assembled from a single sheet of cardboard material. Bliss boxes have several advantages over tray-style boxes. For example, because they are assembled from multiple sheets of cardboard material rather than a single sheet, a wider variety of box designs are possible, and less raw material (e.g., cardboard) is required. Individual features and dimensions of a bliss box can be modified more readily than can individual features and dimensions of a tray-style box.

In bliss box designs, conventional wisdom has held that stronger boxes (that is, boxes that can carry more weight loaded on top of the box) are achieved by increasing the number of vertical flutes of the cardboard material that can carry vertical compressive forces to the ground. Similarly, conventional wisdom has held that more efficient boxes are achieved by providing more vertical flutes to carry compressive forces to the ground per weight of cardboard material used. The designs disclosed herein reject this conventional wisdom by reducing the number of flutes which carry compressive forces to the ground. In particular, the inclusion of the notches 222, 224, and indentations 126 represent a significant reduction in the number of vertical flutes which carry compressive forces to the ground. It has been found, however, that providing the stack tabs as described above more than compensates for this loss of strength in a bliss box, and thus makes the box more efficient overall.

Figure 8:
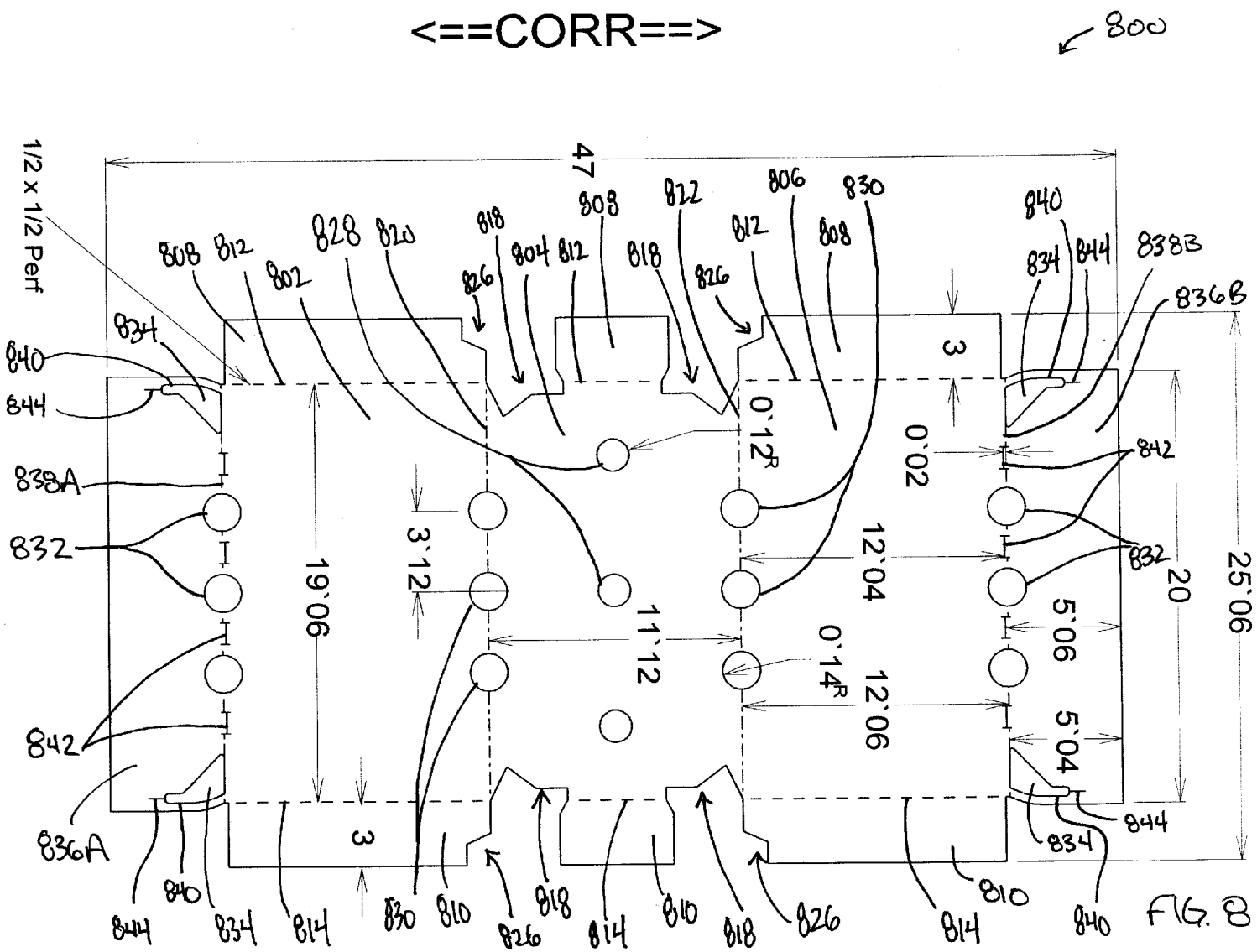
FIG. 8 shows another exemplary first box portion with exemplary dimensions.

FIG. 8 shows another exemplary first box portion 800, which can have a structure similar to that of first box portion 100, including a first side portion 802, a bottom portion 804, a second side portion 806, and end tabs 808 and 810. First box portion 800 can also include first and second top flap portions 836A, 836B. When a box is assembled, the first and second top flap portions 836A, 836B can cover the top of the box and reduce contamination of its contents, as well as serve as an additional surface on which graphics can be printed. Fold line 838A can separate first top flap portion 836A from first side portion 802. Fold line 820 can separate first side portion 802 from bottom portion 804. Fold line 822 can separate bottom portion 804 from second side portion 806. Fold line 838B can separate second side portion 806 from second top flap portion 836B. Fold lines 812 can separate each of the first end tabs 808 from the rest of the first box portion 800, and fold lines 814 can separate each of the second end tabs 810 from the rest of the first box portion 800.

FIG. 8 shows that the bottom portion 804 can include four stack tab receiving cutouts 818, one in each of the four corners of the bottom portion 804, which can be sized to receive stack tabs of another box, as further explained herein. The cutouts 818 can have a generally angled shape to accommodate an angled stack tab of another box as described herein. FIG. 8 also shows that each of the first and second top flap portions 836A, 836B can include two corner cutouts 834 and two corner slits 844. The cutouts 834 and the slits 844 can be sized and located such that when a box is assembled and the first box portion 800 is folded along fold lines 838A, 838B, they receive a stack tab of the box. In this assembled configuration, stack tabs of the box can be pinched within the slits 844 such that friction between the stack tabs and the edges of the cardboard surrounding the slits 844 resists the unfolding of the first box portion and the opening of the box.

FIG. 8 also shows that the first side portion 802 and second side portion 806 can be provided with indentations 826. In some cases, these indentations 826 can facilitate the insertion of the stack tab of another box into the cutouts 818, and/or can provide channels through which air can flow to aerate products held in a box. FIG. 8 also shows that three circular openings 830 can be provided along each of fold lines 820, 822, and that three circular openings 832 can be provided along each of fold lines 838A, 838B. Further, three circular openings 828 can be provided in the bottom portion 804. The openings 828, 830, 832 can provide additional air flow channels for aeration of products held in a box. FIG. 8 also shows that fold lines can be perforated to facilitate folding of the cardboard material along desired lines, for example, with ½" slits separated by ½" spaces. FIG. 8 also shows that the flutes of the corrugated cardboard material can run in a direction from the first top flap 836A to the second top flap 836B.

FIG. 8 shows that the first box portion 800 can have an overall length 47", and an overall width 25 6/16". The first and second side portions 802, 806 can each have an overall length 12 6/16, the bottom portion 804 can have an overall length 11 12/16", and the first and second top flap portions 836A, 836B can each have an overall length 5 4/16". The end tabs 808, 810 can have a width 3". The first side portion 802, bottom portion 804, and second side portion 806, excluding the end tabs 808, 810, can each have a width 19 6/16". Each of the top flap portions 836A, 836B can have an overall width 20", which can be 10/16" wider than the first and second side portions 802, 806, and the end portion 804. In this embodiment, the corner cutouts 834 of top flap portion 836A or 836B can have lateral edges 840 which are spaced apart from one another by the width of the respective side portion 802 or 804.

The openings 830 and 832 can each have a radius 14/16", and the openings 830, 832 aligned along a respective fold line can be spaced apart from one another by 3 12/16" (measured from the center of one opening to the center of another opening). The openings 828 can each have a radius 12/16". The first box portion 800 can also include a plurality of generally H-shaped slits 842 in the region of, but offset from, the fold lines 838A, 838B. In some cases, the slits 842 can be offset from the fold lines 838A, 838B by 2/16". The H-shaped slits 842 can make it easier to fold the first box portion 800 along the fold lines 838A, 838B. Further, when the first box portion 800 is folded along the fold lines 838A, 838B, the cardboard on either side of each of the slits 842 can separate, due to the offset between the slits 842 and the fold lines 838A, 838B. When unfolding the first box portion 800 along fold lines 838A, 838B, the cardboard on either side of each of the slits 842 engage one another and resist the unfolding, due to frictional engagement between the cardboard on either side of the slits 842. Thus, the slits 842 can help to resist the unintended unfolding of the first box portion (i.e., the unintended opening of a complete box).

Figure 9:
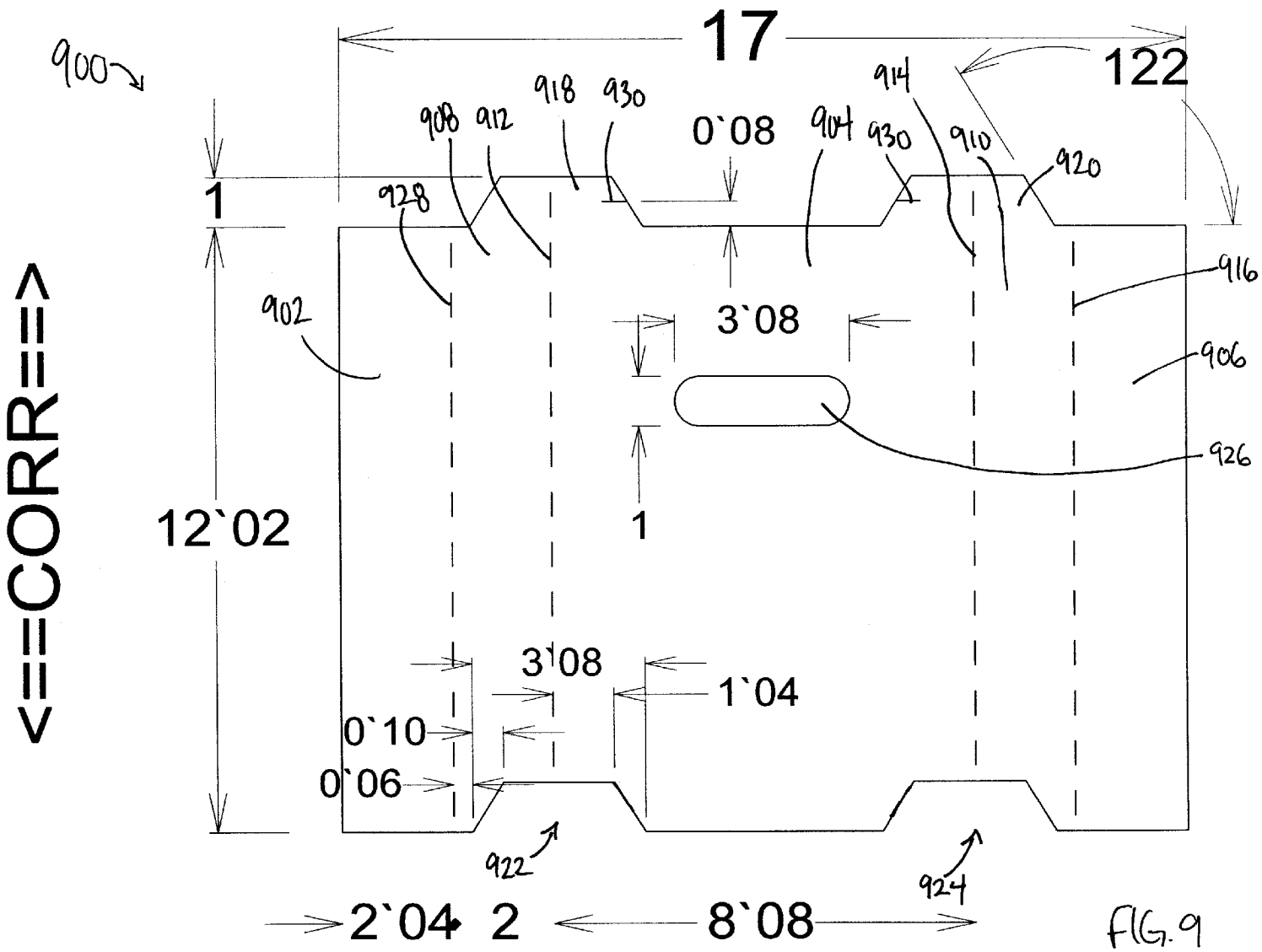
FIG. 9 shows another exemplary second box portion with exemplary dimensions.

FIG. 9 shows another exemplary second box portion 900 with exemplary dimensions. As shown, the second box portion 900 can comprise a first side portion 902, an end portion 904, and a second side portion 906. The second box portion 900 can also include a first intermediate angle portion 908 and a second intermediate angle portion 910. Fold line 928 can separate first side portion 902 from first intermediate angle portion 908, fold line 912 can separate angle portion 908 from end portion 904, fold line 914 can separate end portion 904 from second angle portion 910, and fold line 916 can separate angle portion 910 from second side portion 906. Second box portion 900 can also include a first stack tab 918, a second stack tab 920, a first tab receiving notch 922, and a second tab receiving notch 924, arranged generally as described above for second box portion 200.

The first and second stack tabs 918, 920 can include respective tab slits 930, which can provide a break in the surface of the stack tabs 918, 920. When a box is assembled and the stack tabs 918, 920 are received within corner slits such as corner slits 844 of first box portion 800, the break in the surface of the stack tabs 918, 920 provided by the tab slits 930 can help to retain the top flaps 836A, 836B, resist the unfolding of the first box portion 800, and prevent the unintended opening of the box. The second box portion 900 can also include an oval-shaped cutout 926 which can function as a handle for an assembled box. FIG. 9 also shows that the flutes of the corrugated cardboard material can run in a direction from the tabs 918, 920, to the respective notches 922, 924.

FIG. 9 shows that the second box portion 900 can have an overall length 12 2/16" and an overall width 17". The first side portion 902 and second side portion 906 can each have a width 2 4/16". The first and second angle portions 908, 910, can each have a width 2". The end portion 904 can have a width 8 8/16". The tabs 918, 920 can have a length 1", an angle between the side of the tab and the edge of the second box portion of 122°, and other dimensions complementing those of the respective notches 922, 924. The tab slits 930 can be offset from the edge of the second box portion 900 by 8/16". The notches 922, 924 can have a length 1", a maximum width 3 8/16" at the edge of the second box portion 900, and a minimum width 2 4/16". The notches 922, 924 can be spaced apart from the side portions 902, 906, respectively, by 6/16". Angled portions of the notches 922, 924 can have a length 1" and a width 10/16". The notches 922, 924 can be positioned such that, of the 2 4/16" minimum width of the notches 922, 924, 1 4/16" is situated within the end portion 904, and 1" is situated within the first and second angle portions 908, 910, respectively. The oval-shaped cutout 926 can have a major axis of width 3 8/16", and a minor axis of length 1".

The recited dimensions represent exemplary dimensions suitable in some embodiments. In alternative embodiments, the dimensions of the various components illustrated in FIGS. 8-9 can change based on the product to be carried in the box and other various design requirements. First and second box portions 800, 900 can be used in combination with any other embodiments described herein.

The first box portions 100, 100B, 800 and second box portions 200, 900 can be fabricated from any of various suitable materials, with one exemplary material being cardboard, such as a corrugated cardboard material. Boxes fabricated from corrugated cardboard can be referred to as "corrugated containers." Box 300, formed as described above, provides greater ease of stacking, greater strength, and better efficiency of materials than other known boxes. Box 300 has been shown to provide an additional 41% stacking strength (i.e., overall compressive strength) while using 20% less raw material, when tested against other box designs fabricated from the same batch of raw paper material. Due to this increased efficiency of materials, the amount of material used to fabricate the box can be reduced substantially while retaining strength matching that of current box designs.

In particular, the provision of a stack tab straddling a fold line, such that the stack tab is angled as in box 300, increases the strength of the stack tab, particularly in flexural stiffness and against buckling to the side. In particular, such an angled stack tab can facilitate the use of a single layer stack tab rather than, e.g., a double layer stack tab. Further, stack tabs and corresponding notches having a generally trapezoidal shape can make the stack tab more robust, as it has a wider base, and can facilitate stacking due to the increased size of the notch within which the top of the stack tab is inserted. Overall, the boxes described herein generally provide increased strength, stability, and economy when compared to other known boxes.

Boxes can be fabricated having one, two, three, four, or more stack tabs. Multiple stack tabs can provide additional benefits in terms of stability by helping to ensure that stacked boxes remain vertically aligned. For example, a box having two stack tabs—one in each of diagonally opposing corners—can help to ensure that stacked boxes remain vertically aligned. Various portions of a box can have various designs printed thereon, such as a design indicating goods to be held within the completed box. Various colors and designs can be used as desired.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A box comprising:

a first end portion and a second end portion, wherein the first and the second end portions include a top end portion and a bottom end portion;

the first end portion being separated from a first side portion by a first fold line and being separated from a second side portion by a second fold line, and the second end portion being separated from the first side portion by a third fold line and being separated from the second side portion by a fourth fold line;

the top end portion of at least one end portion including at least one stack tab having a tapered shape as it extends away from the top end portion of the box;

the stack tab bent at a fifth fold line to form an angle of 135 degrees about an axis extending from the top end portion to the bottom end portion, wherein the fifth fold line does not intersect a plane extending from the first fold line to the fourth fold line or a plane extending diagonally from the second fold line to the third fold line; and the bottom end portion of at least one end portion including at least one notch.

2. The box of claim 1, further comprising:

the box is a first box situated on top of a second box, the second box comprising a first end portion and a second end portion, wherein the first and the second end portions include a top end portion and a bottom end portion;

the first end portion being separated from a first side portion by a first fold line and being separated from a second side portion by a second fold line, and the second end portion being separated from the first side portion by a third fold line and being separated from the second side portion by a fourth fold line;

the top end portion of at least one end portion of the second box including at least one stack tab, the stack tab of the second box having a tapered shape as it extends away from the top end portion of the second box;

the stack tab of the second box bent at a fifth fold line to form an angle of 135 degrees about an axis extending from the top end portion of the second box to the bottom end portion of the second box, wherein the fifth fold line does not intersect a plane extending diagonally from the first fold line to the fourth fold line or a plane extending from the second fold line to the third fold line;

the stack tab of the second box situated within the notch of the first box; and the bottom end portion of the second box including at least one notch configured to receive a stack tab of a third box.

3. The box of claim 1, wherein the stack tab comprises a single layer of cardboard material.

4. The box of claim 1, wherein the box is comprised of three separate sheets of cardboard material.

5. The box of claim 1, wherein the stack tab has a shape comprising a trapezoid.

6. The box of claim 1, wherein the stack tab has a shape comprising a trapezoid with rounded corners.

7. The box of claim 1, wherein the stack tab has a shape comprising a base portion and a top portion, the top portion being smaller in cross-section than the base portion.

8. The box of claim 1, wherein the stack tab has a shape comprising a portion of a circle.

9. A box comprising:

four corners;

a first box portion having a first side portion, a bottom portion, and a second side portion, wherein a first fold line separates the first side portion from the bottom portion and a second fold line separates the bottom portion from the second side portion; and a second box portion having an angle portion, an end portion, a stack tab, and a notch, wherein a third fold line separates the angle portion from the end portion, wherein the stack tab extends outwardly from the angle portion and the end portion, straddling the third fold line, and wherein the notch extends inwardly into the angle portion and the end portion, straddling the third fold line;

the second box portion folded at the third fold line such that an angle between the angle portion and the end portion is 135 degrees and the third fold line does not vertically align with a plane extending diagonally from one corner of the box to another corner of the box; and the stack tab having a tapered shape as it extends outwardly from the angle portion and the end portion.

10. The box of claim 9, wherein the box is a top box situated on top of a bottom box, the bottom box comprising:

four corners;

a first box portion having a first side portion, a bottom portion, and a second side portion, wherein a first fold line separates the first side portion of the bottom box from the bottom portion of the bottom box and a second fold line separates the bottom portion of the bottom box from the second side portion of the bottom box;

a second box portion having an angle portion, an end portion, a stack tab, and a notch, wherein a third fold line separates the angle portion of the bottom box from the end portion of the bottom box, wherein the stack tab of the bottom box extends outwardly from the angle portion of the bottom box and the end portion of the bottom box, straddling the third fold line of the bottom box, and wherein the notch of the bottom box extends inwardly into the angle portion of the bottom box and the end portion of the bottom box, straddling the third fold line of the bottom box;

the second box portion of the bottom box folded at the third fold line of the bottom box such that an angle between the angle portion of the bottom box and the end portion of the bottom box is 135 degrees and the third fold line does not vertically align with a plane extending diagonally from one corner of the bottom box to another corner of the bottom box; and the stack tab of the bottom box situated within the notch of the top box.

11. The box of claim 9, wherein the first box portion and the second box portion each comprise a separate respective sheet of cardboard material.

12. The box of claim 9, wherein the stack tab comprises a single layer of cardboard material.

13. The box of claim 9, wherein the box comprises three separate sheets of cardboard material.

14. The box of claim 9, wherein the stack tab has a shape comprising a trapezoid.

15. The box of claim 9, wherein the first box portion includes a first top flap portion and a second top flap portion, wherein a fourth fold line separates the first top flap portion from the first side portion, and wherein a fifth fold line separates the second top flap portion from the second side portion.

16. A box comprising:

a first box portion having a first side portion, a bottom portion, and a second side portion, wherein a first fold line separates the first side portion from the bottom portion and a second fold line separates the bottom portion from the second side portion;

a second box portion having a first angle portion, a first end portion, a second angle portion, a first stack tab, a second stack tab, a first notch, and a second notch, wherein a third fold line separates the first angle portion from the first end portion and a fourth fold line separates the first end portion from the second angle portion, wherein the first stack tab extends outwardly from the first angle portion and the first end portion, straddling the third fold line and the first notch extends inwardly into the first angle portion and the first end portion, straddling the third fold line, and wherein the second stack tab extends outwardly from the second angle portion and the first end portion, straddling the fourth fold line and the second notch extends inwardly into the second angle portion and the first end portion, straddling the fourth fold line; and a third box portion having a third angle portion, a second end portion, a fourth angle portion, a third stack tab, a fourth stack tab, a third notch, and a fourth notch, wherein a fifth fold line separates the third angle portion from the second end portion and a sixth fold line separates the second end portion from the fourth angle portion, wherein the third stack tab extends outwardly from the third angle portion and the second end portion, straddling the fifth fold line and the third notch extends inwardly into the third angle portion and the second end portion, straddling the fifth fold line, and wherein the fourth stack tab extends outwardly from the fourth angle portion and the second end portion, straddling the sixth fold line and the fourth notch extends inwardly into the fourth angle portion and the second end portion, straddling the sixth fold line;

wherein the first box portion, the second box portion, and the third box portion each comprise a separate respective sheet of cardboard material;

wherein the second box portion is folded at the third fold line such that an angle between the first angle portion and the first end portion is 135 degrees and the second box portion is folded at the fourth fold line such that an angle between the second angle portion and the first end portion is 135 degrees;

wherein the third box portion is folded at the fifth fold line such that an angle between the third angle portion and the second end portion is 135 degrees and the third box portion is folded at the sixth fold line such that an angle between the fourth angle portion and the second end portion is 135 degrees; and wherein the first stack tab has a tapered shape as it extends outwardly from the first angle portion and the first end portion, the second stack tab has a tapered shape as it extends outwardly from the second angle portion and the first end portion, the third stack tab has a tapered shape as it extends outwardly from the third angle portion and the second end portion, and the fourth stack tab has a tapered shape as it extends outwardly from the fourth angle portion and the second end portion.

* * * * *